US005141164A

United States Patent [19]

Ohno et al.

[11] Patent Number: 5,141,164

[45] Date of Patent: Aug. 25, 1992

[54] FUEL INJECTOR

[75] Inventors: Eishi Ohno, Mishima; Yushiro Yasuda, Susono; Norihiko Nakamura, Mishima; Toshio Tanahashi, Susono; Yasuhiko Ishida, Mishima; Hideto Takeda; Nobuo Ri, both of Kariya, all of Japan

[73] Assignees: Nippondenso Co., Ltd., Kariya; Toyota Jidosha Kabushiki Kaisha, Toyota, Japan

[21] Appl. No.: 616,835

[22] Filed: Nov. 21, 1990

[30] Foreign Application Priority Data

Dec. 8, 1989 [JP] Japan ..... 1-317726
May 16, 1990 [JP] Japan ..... 2-124226

[51] Int. Cl.[5] ..... B05B 1/30

[52] U.S. Cl. ..... 239/585.2; 251/129.01; 251/129.1

[58] Field of Search ..... 239/585; 251/129.18, 251/129.09, 129.1

[56] References Cited

U.S. PATENT DOCUMENTS

| | | | |
|---|---|---|---|
| 2,901,210 | 8/1959 | Hebard | 251/129.1 |
| 4,342,443 | 8/1982 | Wakeman . | |
| 4,361,309 | 11/1982 | Sogabe | 251/129.09 |
| 4,403,741 | 9/1983 | Moriya et al. | 239/585 |
| 4,458,289 | 7/1984 | Lukasczyk | 251/129.08 |
| 4,690,371 | 9/1987 | Bosley et al. | 251/129.1 |
| 4,798,188 | 1/1989 | Ito et al. . | |
| 4,972,996 | 11/1990 | Cerny | 239/585 |
| 5,004,154 | 4/1991 | Yoshida et al. | 239/585 |

FOREIGN PATENT DOCUMENTS

| | | | |
|---|---|---|---|
| 2237746 | 2/1974 | Fed. Rep. of Germany | 239/585 |
| 58-72455 | 5/1983 | Japan . | |
| 58-146874 | 10/1983 | Japan . | |
| 0172458 | 10/1983 | Japan | 239/585 |
| 60-78979 | 6/1985 | Japan . | |
| 61-5543 | 2/1986 | Japan . | |
| 62-14166 | 1/1987 | Japan . | |
| 2150978 | 7/1985 | United Kingdom | 239/585 |

*Primary Examiner*—Andres Kashnikow
*Assistant Examiner*—Christopher G. Trainor
*Attorney, Agent, or Firm*—Cushman, Darby & Cushman

[57] ABSTRACT

A fuel injector comprising a needle valve and a stop member cooperating with the needle valve. The stop member selectively controls the maximum amount of lift of the needle valve to provide a smaller maximum lift or a larger maximum lift thereof whereby, when the required amount of fuel to be injected by the fuel injector is small, the needle valve is lifted to the smaller maximum lift, and when the required amount of fuel is large, the needle valve is lifted to the larger maximum lift.

16 Claims, 7 Drawing Sheets

FUEL INJECTOR

BACKGROUND OF THE INVENTION

1. Field of the Invention

The present invention relates to a fuel injector for use in an internal combustion engine, and more particularly, relates to a fuel injector by which fuel is atomized and injected under a relatively low pressure directly into the combustion chamber of a two-stroke engine.

2. Description of the Related Art

A fuel injector for use in an internal combustion engine has a construction such that it is able to inject a required correct amount of fuel even when a minimum required amount of fuel is to be injected. The required amount of fuel to be injected however, changes considerably in accordance with a change in the operating state of the engine, and therefore, particularly where a low pressure fuel injector is used, when the required amount of fuel to be injected is increased, the injection time of the fuel injector becomes considerably longer. Nevertheless, for example, in a two-stroke engine, the injecting operation of the fuel must be completed within a short time, and therefore, where a low pressure fuel injector is used in a two-stroke engine, it is difficult to inject a necessary amount fuel over the entire range of from the minimum required amount to the maximum required amount.

Therefore, where the injecting operation must be completed within a short time, usually separate fuel injectors for a small amount of fuel and fuel injector for a large amount of fuel are provided. Namely, when the required amount of fuel is small, fuel is fed from the fuel injector for the small amount of fuel, and when the required amount of fuel is large, additional fuel is fed from the fuel injector for the large amount of fuel (see Japanese Examined Patent Publication No. 61-5543).

Nevertheless, as well known to a person skilled in the art, in practice it is often difficult to arrange two injectors in a combustion chamber and the like, in view of the space limitations involved.

In another known fuel injector, a valve lift control means comprising a spring (referred to as a delay spring) is provided, to thereby expand the controllable range of the amount of fuel injected by the fuel injector and correctly control the amount of fuel injected by the fuel injector. This delay spring is arranged between the needle and the movable core, and when the movable core is attracted by the energized exciting coil, the attracting force for the movable coil is accumulated in the delay spring for a predetermined time. Thereafter, the attracting force thus accumulated is added to the attracting force caused by the exciting coil, and these attracting forces are transmitted to the needle (see Japanese Unexamined Utility Model Publication No. 58-72455).

Even if such delay spring is used, however, it is difficult to expand the controllable range of the amount of fuel injection over the wide range of from a small amount to a large amount, and to carry out a fine adjustment of the amount of fuel injected.

SUMMARY OF THE INVENTION

An object of the invention is to provide a fuel injector capable of correctly controlling the amount of fuel injection over a wide range.

Therefore, according to the present invention, there is provided a fuel injector comprising a housing having a fuel passage provided with a valve port therein; a needle valve movable in the housing and cooperating with the valve port; an actuator for actuating the needle valve to close the valve port when the fuel injection is to be stopped and open the valve port to control the flow rate of fuel passing through the valve port per unit time when the fuel injection is to be carried out, and control means for selectively controlling the flow rate of fuel to provide a first flow rate of fuel, or a second flow rate of fuel larger than the first flow rate of fuel, when the needle valve opens the valve port.

The present invention may be more fully understood from the description of preferred embodiment of the invention set forth below, together with the accompanying drawings.

DESCRIPTION OF THE PREFERRED EMBODIMENTS

Figure 1:
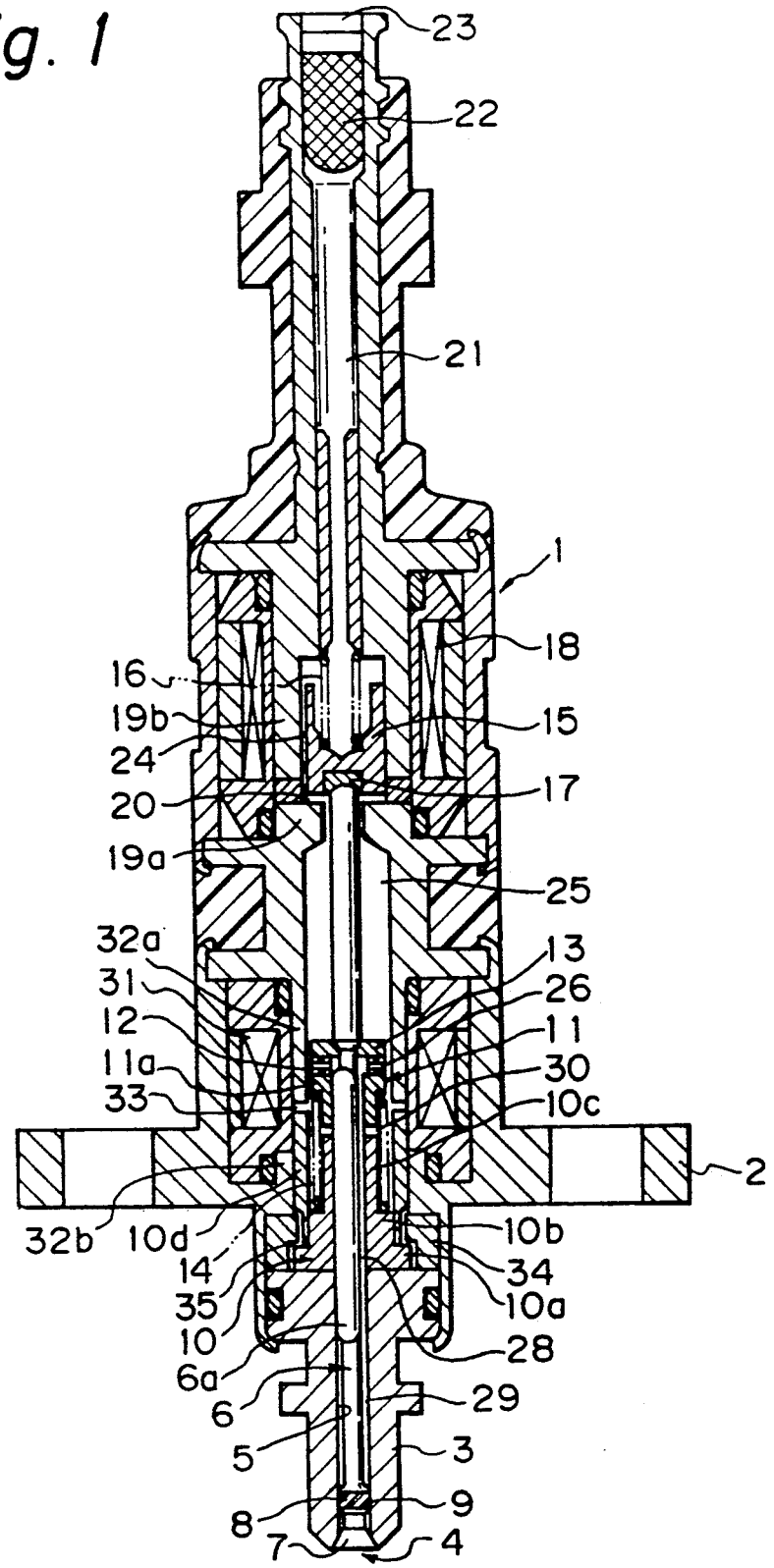
FIG. 1 is a cross-sectional side view of a first embodiment of a fuel injector according to the present invention.

FIG. 1 illustrates a first embodiment of the present invention, which is applied to a low pressure fuel injector.

Referring to FIG. 1, reference numeral 1 designates a fuel injector body, 1 a flange 2 for fixing the fuel injector body 1 to, for example, the cylinder head (not shown), and 3 a nozzle holder fixed to the tip end of the fuel injector body 1. A nozzle opening 4 is formed in the tip end of the nozzle holder 3, a needle insertion bore 5 is formed in the body of the nozzle holder 3, and a needle 6 is slidably inserted into the needle insertion bore 5. A conically shaped valve head 7 is formed on the tip end of the needle 6, and a cylindrical enlarged portion 8 is formed on the needle 6 near the conically shaped valve head 7, to maintain the needle 6 at the required position. A plurality of spiral grooves 9 are formed on the cylindrical enlarged portion 8.

A stop member 10, which can be seated on the inner end face of the nozzle holder 3, is slidably inserted around the needle 6. This stop member 10 comprises a larger diameter lower end portion 10*a*, a middle diameter intermediate portion 10*b*, a smaller diameter upper end portion 10*c*, and a hollow cylindrical core portion 10*d* arranged coaxially with the smaller diameter upper end portion 10*c* and welded to the middle diameter intermediate portion 10*b*. A spring retainer 11 is fitted on the needle 6 above the smaller diameter upper end portion 10*c* of the stop member 10, and a spacer 12 and a snap ring 13 are fitted into the groove of the needle 6 above the spring retainer 11. A compression spring 14 is inserted between the enlarged head portion 11*a* of the spring retainer 11 and the middle diameter intermediate portion 10*b* of the stop member 10, and the spring force of the compression spring 14 is transferred to the needle 6 via the spring retainer 11, the spacer 12 and the snap ring 13. Accordingly, the needle 6 is continuously biased upward by the spring force of the compression spring 14, and thus the valve head 7 of the needle 6 normally closes the nozzle opening 4.

A movable core 15 is slidably inserted above the upper end of the needle 6 and urged onto the upper end portion of the needle 6 by the spring force of a compression spring 16. This compression spring 16 has a spring force which is weaker than that of the compression spring 14. A wear-proof member 17 is fitted in the portion of the lower end face of the movable core 15 which is in contact with the upper end portion of the needle 6.

A first exciting coil 18 constructing a first actuator is arranged around the movable core 15. When the first exciting coil 18 is energized, the magnetic path passing through a stator portion 19*a*, an air gap 20 between the stator portion 19*a* and the movable core 15, and between the movable core 15 and a stator portion 19*b*. is formed, and at this time the movable core 15 moves in a direction by which the air gap 20 is reduced. A fuel passage 21 is formed above the movable core 15 and connected to a fuel inlet 23 via a filter 22.

Fuel is introduced into the fuel passage 21 from the fuel inlet 23, via the filter 22, and then introduced into a fuel chamber 25 formed around the needle 6 via a fuel flow groove 24 formed on the outer face of the movable core 15. The fuel then flows into a gap between the needle 6 and the spring retainer 11 via fuel flow bores 26 formed in the spacer 12. A portion of the needle 6, located between the spring retainer 11 and the stop member 10, has three projections 6*a* formed thereon, i.e., has a triangular cross-section, and fuel flow grooves 28 are formed between the adjacent projections 6*a*. Consequently, the fuel in the gap between the needle 6 and the spring retainer 11 is introduced into a space behind the valve head 7, via the fuel flow grooves 28 and an annular fuel flow passage 29 formed between the needle insertion bore 5 and the needle 6 and then via the spiral grooves 9. When the first exciting coil 18 is energized by a current fed to the terminal (not shown), since the movable core 15 is moved in a direction which causes the air gap 20 to be reduced, as mentioned above, the needle 6 is moved downward against the compression spring 14, and as a result, the valve head 7 opens the nozzle opening 4 and fuel is injected from the nozzle opening 4.

As can be seen from FIG. 1, an air gap 30 is formed between the upper end face of the smaller diameter upper end portion 10*c* of the stop member 10 and the lower end face of the spring retainer 11, and when the first exciting coil 18 is energized, the needle 6 is moved downward until the lower end face of the spring retainer 11 abuts against the upper end face of the smaller diameter upper end portion 10*c* of the stop member 10. Accordingly, since the maximum amount of lift of the needle 6 at this time is substantially equal to the axial length of the air gap 30, it is possible to control the maximum lift position of the needle 6 by changing the width of the air gap 30. Note that, since the lower end face of the stop member 10 is seated on the nozzle holder 3, when the spring retainer 11 abuts against the stop member 10, the spring retainer 11, i e., the needle 6, is firmly held at a position at which the spring retainer 11 abuts against the stop member 10.

A second exciting coil 31 as a second actuator is arranged around the hollow cylindrical core portion 10*d* of the stop member 10. When the second exciting coil 31 is energized, the magnetic path passing through a stator portion 32*a*, an air gap 33 between the stator portion 32*a* and the core portion 10*d*, the core portion 10*d*, and a stator portion 32*b* is formed, and at this time, the core portion 10*d* is moved in a direction at which the air gap 33 is reduced. Further, a position restricting ring 34 is inserted between the fuel injector body 1 and the nozzle holder 3, to restrict the amount of movement of the stop member 10, and an air gap 35 is formed between the position restricting ring 34 and the larger diameter lower end portion 10*a* of the stop member 10. This air gap 35 has an axial length less than the axial length of the air gap 33 between the stator portion 32*a* and the core portion 10*d* and the axial length of the air gap 30 between the spring retainer 11 and the stop member 10.

When the second exciting coil 31 is energized by a current fed to the terminal (not shown), the core portion 10*d* is moved in the direction which causes the air gap 33 to be reduced, as mentioned above. At this time, the stop member 10 is moved away from the nozzle holder 3 and upward until the periphery of the top face of the larger diameter lower end portion 10*a* abuts against the position restricting ring 34. As a result, the axial length of the air gap 30 between the spring retainer 11 and the stop member 10 is reduced by an amount corresponding to the axial length of the air gap 35. Consequently, in this state, if the first exciting coil 18 is energized, the amount of movement of the needle 6 becomes small, and thus the maximum amount of lift of the needle 6 is reduced. Since the stop member 10 is strongly urged onto the position restricting ring 34 as long as the second exciting coil 31 is energized, when the spring retainer 11 abuts against the stop member 10, the spring retainer 11, i.e., the needle 6, is firmly held at a position at which the spring retainer 11 abuts against the stop member 10.

Figure 2:
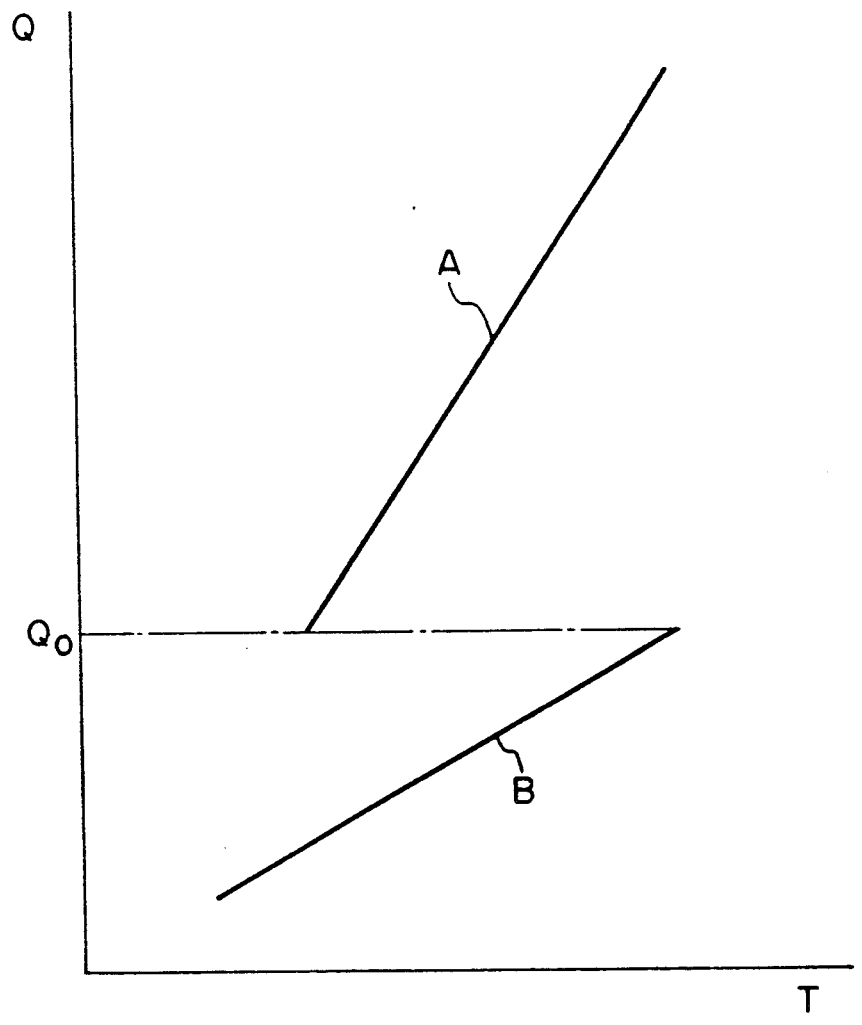
FIG. 2 is a diagram illustrating the relationship between the injection time and the amount of fuel injected, in the first embodiment of the present invention.

FIG. 2 illustrates the relationship between the amount of injected fuel Q and the injection time T, where the maximum lift position of the needle 6 is obtained by controlling the stop member 10 shown in the first embodiment illustrated in FIG. 1. In FIG. 2, the straight line A indicates the case wherein the second exciting coil 31 is deenergized, i.e., indicates the state illustrated in FIG. 1, and the straight line B indicates the case wherein the second exciting coil 31 is energized. If the maximum amount of lift of the needle 6 becomes small, the amount of fuel injected per unit time is reduced, and accordingly even if the injection time T is the same, the amount of fuel injected Q in the case illustrated by the straight line B becomes smaller than that in the case illustrated by the straight line A. In the first embodiment illustrated in FIGS. 1 and 2, when the required amount of fuel to be injected is smaller than $Q_O$, the second exciting coil 31 is energized to reduce the maximum amount of lift of the needle 6, and when the required amount of fuel to be injected is larger than $Q_O$, the second exciting coil 31 is deenergized to increase the maximum amount of lift of the needle 6. As a result, the amount of fuel to be injected can be controlled over a wide range of from the minimum required fuel injection amount to the maximum required fuel injection amount, within a short injection time.

In the first embodiment illustrated in FIG. 1, the compression spring 14 has two functions, i.e., a function of biasing the needle 6 in the closed direction and a function of strongly urging and holding the stop member 10 on the nozzle holder 3. In addition, the spring retainer 11 has two functions, i.e., a function of transmitting the spring force of the compression spring 14 to the needle 6 and a function of cooperating with the stop member 10 and restricting the maximum lift position of the needle 6. Furthermore the core portion 10*d* of the stop member 10 is slidably inserted on the inner wall of the fuel chamber 25 and thus has an additional function of guiding the up and down movement of the stop member 10.

In the embodiment illustrated in FIG. 1, if the axial length of the air gap 30 or the axial length of the air gap 35 deviates from a predetermined axial length due to, for example, irregularities in the accuracy of the parts constructing the fuel injector, the amount of fuel injected will deviate from the predetermined amount. The amount of fuel of injected, however, depends not only on the axial length of the air gap 30 or 35, but also on the velocity of the upward movement or the downward movement of the needle 6, i.e., on the responsiveness of the movement of the needle 6 and, therefore, even if the axial length of the air gap 30 or 35 deviates from a predetermined axial length, it is possible to adjust the amount of fuel injected so that it becomes equal to a predetermined amount, by changing the responsiveness of the movement of the needle 6.

Figure 3:
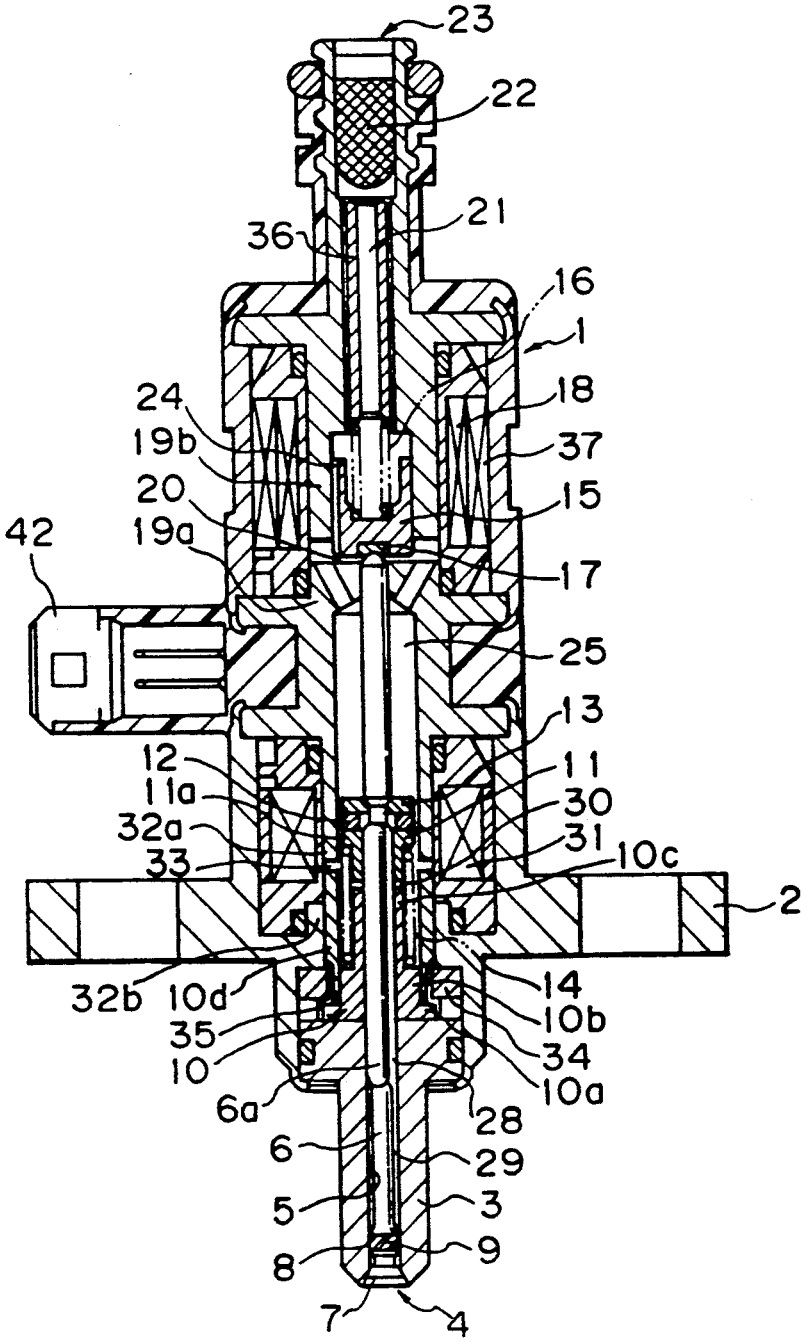
FIG. 3 is a cross-sectional side view of a second embodiment of a fuel injector.
Figure 4:
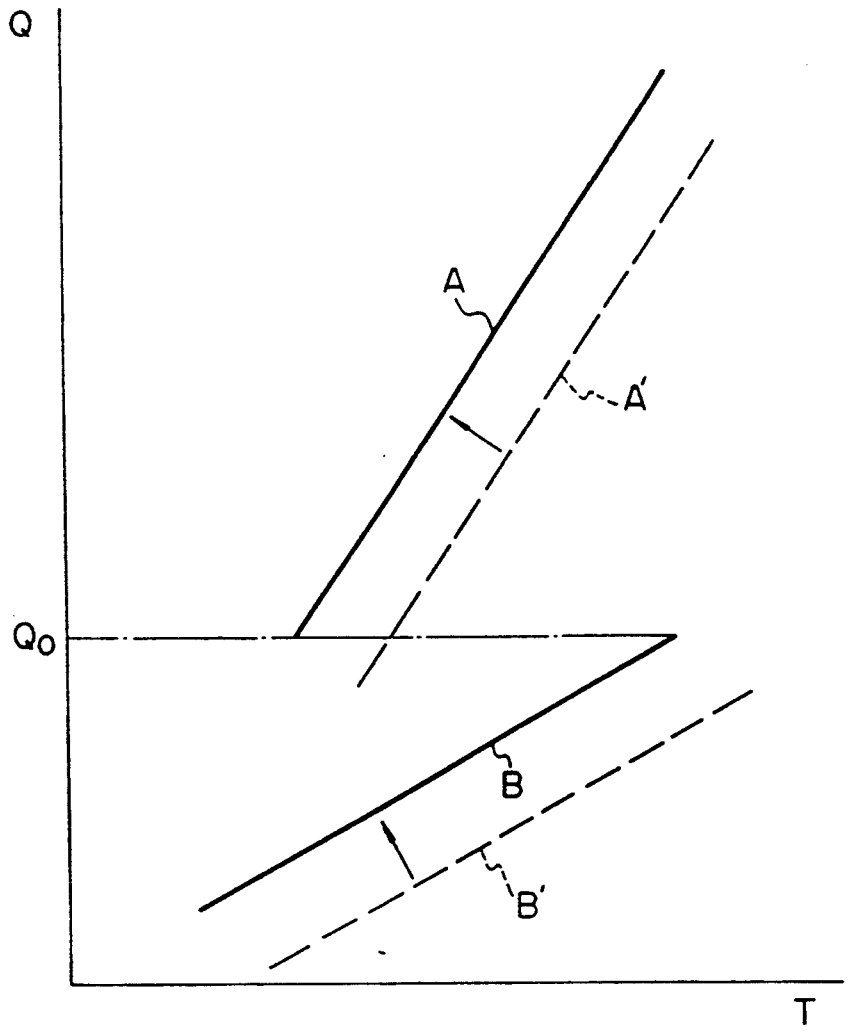
FIG. 4 is a diagram illustrating the relationship between the injection time and the amount of fuel injected, in the second embodiment of the present invention.
Figure 5A:
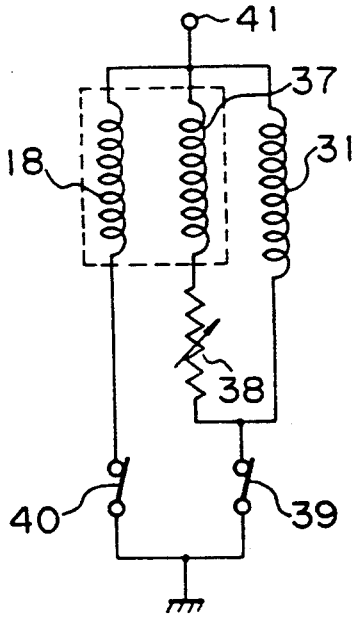
FIGS. 5(A) and 5(B) show a circuit diagram of the exciting coils.
Figure 5B:
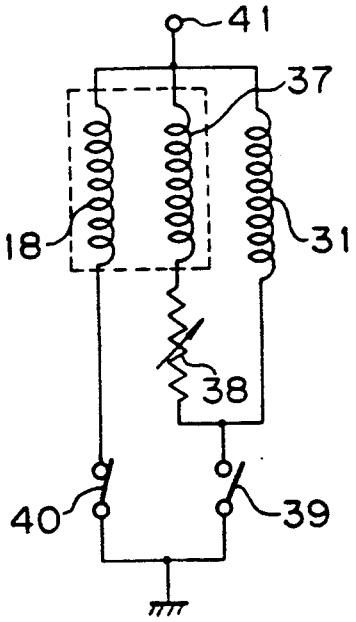
Figure 6:
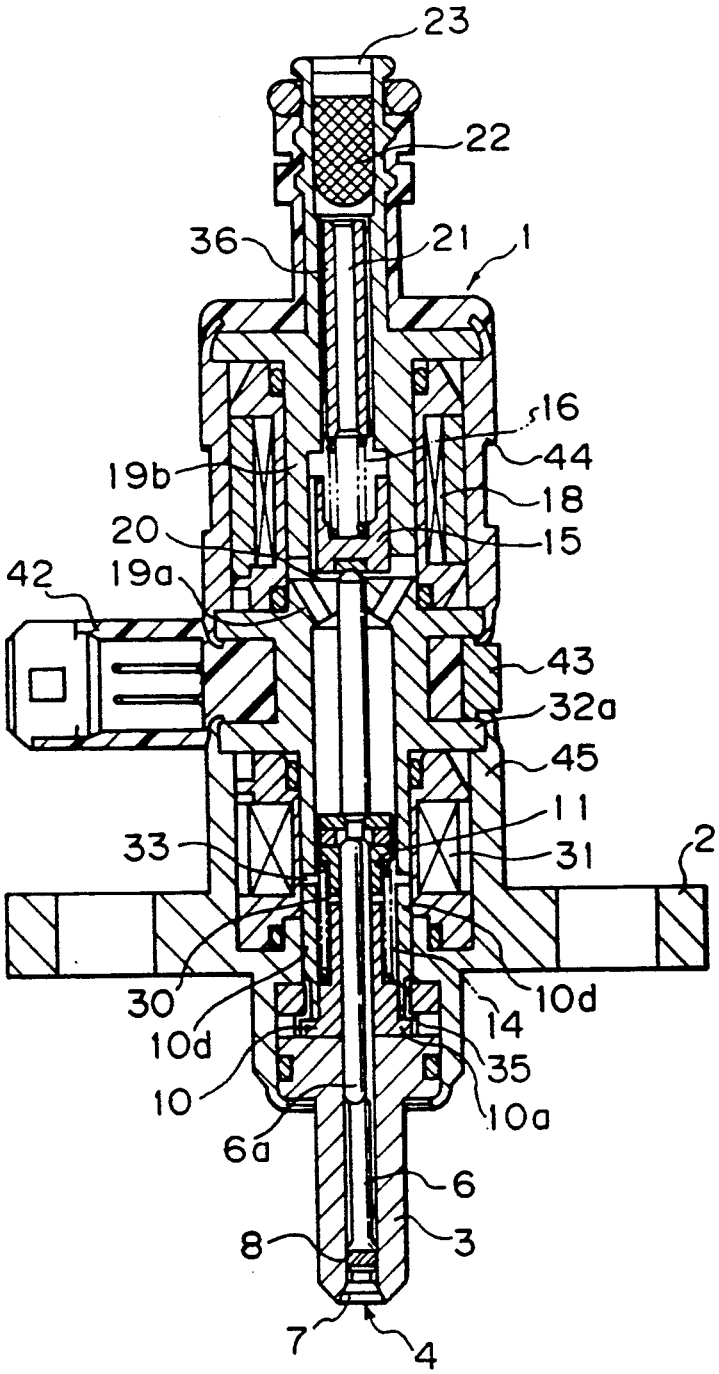
FIG. 6 is a cross-sectional side view of a third embodiment of a fuel injector.
Figure 7:
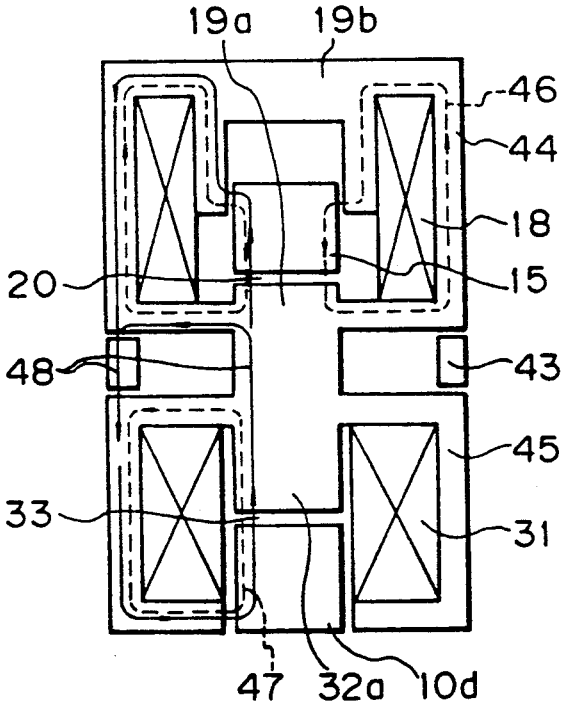
FIG. 7 is a schematically illustrated view of the main portion of the third embodiment, illustrating the magnetic path therein.

FIG. 3 through 5 illustrate a second embodiment which is capable of adjusting the amount of fuel injected, and FIGS. 6 and 7 illustrate a third embodiment which is also capable of adjusting the amount of fuel injected. In these embodiments, similar components are indicated by the same reference numerals as used in FIG. 1.

Referring to FIG. 3, illustrating the second embodiment, the hollow cylindrical sleeve 36 defining the fuel passage 21 therein is screwed into the stator portion 19*b*, and the upper end of the compression spring 16 is seated on the lower end face of the hollow cylindrical sleeve 36. Accordingly, when the hollow cylindrical sleeve 36 is rotated by a suitable tool, the hollow cylindrical sleeve 36 is caused to move upward or downward, and thus the spring force of the compression spring 16 is changed. As a result, the force biasing the movable core 15 downward is changed, and thus the responsiveness of the movement of the needle 6 is changed.

In addition, in the second embodiment, a third exciting coil 37 is arranged around the second exciting coil 18. As illustrated in FIGS. 5(A) and 5(B), one end of the first exciting coil 18 is grounded via a switching element 40, and the other end of the first exciting coil 18 is connected to a terminal 41. This terminal 41 is connected to a power source such as a battery (not shown). In FIG. 3, reference numeral 42 designates a terminal portion for the connection, which includes the terminal 41. As shown in FIGS. 5(A) and 5(B), one end of the second exciting coil 31 is grounded via a switching element 39, and the other end of the second exciting coil 31 is connected to the terminal 41, and further, a variable resistor 38 is connected to the third exciting coil 37 in series, and the third exciting coil 37 and the variable resistor 38 are connected in parallel to the second exciting coil 31. Namely, one end of the third exciting coil 37 is grounded via the variable resistor 38 and the switching element 39, and the other end of the third exciting coil 37 is connected to the terminal 41. The switching elements 39 and 40 may be formed by a relay or a semiconductor switch.

FIG. 5(A) illustrates the case wherein the switching element 39 is made ON, and accordingly, the second exciting coil 31 is energized, i.e., where the maximum amount of lift of the needle 6 is small. FIG. 5(B) illustrates the case wherein the switching element 39 is made OFF, and accordingly, the second exciting coil 31 is deenergized, i.e., where the maximum amount of lift of the needle 6 is large. As seen from FIG. 5(B), where the amount of lift of the needle 6 is large, the second exciting coil 31 and the third exciting coil 37 remain deenergized, i.e., at this time the resistance value of the variable resistor 38 has no influence on the attracting force for the movable core 15. Therefore, at this time, by changing the responsiveness of the movement of the needle 6 by rotating the hollow cylindrical sleeve 36, it is possible to change the amount of fuel injected. Namely, assuming, as illustrated by the broken line A, in FIG. 4, that the amount of fuel injected Q deviates from the desired amount of fuel injected Q illustrated by the solid line A, due to, for example, irregularities in the accuracy of the parts, it is possible to adjust the amount of fuel injected Q by rotating the hollow cylindrical sleeve 36 so that it changes along the solid line A.

Conversely, as seen from FIG. 5(A), where the amount of lift of the needle 6 is small, both the second exciting coil 31 and the third exciting coil 37 are energized. Namely, at this time, since the second exciting coil 31 is energized, the stop member 10 is moved upward until the larger diameter lower end portion 10*a* abuts against the position restricting ring 14. In addition, at this time, although the third exciting coil 37 is energized, the needle 6 is not moved upward by energizing only the third exciting coil 37, and the needle 6 is moved upward only when the first exciting coil 18 is also energized. At this time, by changing the resistance value of the variable resistance 38, the attracting force for the movable core 15 is changed, and as a result, since the responsiveness of the movement of the needle 6 is changed, the amount of fuel injected is changed. That is, it is possible to change the amount of fuel injected by changing the resistance value of the variable resistance 38. Therefore, assuming, as illustrated by the broken line B, in FIG. 4, that the amount of fuel injected Q deviates from the desired amount of fuel injected Q illustrated by the solid line B, due to, for example, irregularities in the accuracy of the parts, it is possible to adjust the amount of fuel injected Q so that it changes along the solid line B.

As mentioned above, in the second embodiment, it is possible to independently adjust the amount of fuel injected when the maximum lift of the needle 6 is small or large, respectively, and accordingly, it is possible to easily adjust the amount of fuel injected so that it becomes equal to the desired amount of fuel injected as illustrated by the solid lines A and B.

Next, the third embodiment will be described with reference to FIGS. 6 and 7.

In the first embodiment and the second embodiment, illustrated in FIG. 1 and FIG. 3 respectively, the magnetic path formed by the first exciting coil 18 and the magnetic path formed by the second exciting coil 31 are formed independently. Conversely, in the third embodiment, an additional core 43 for this adjustment is provided, for bridging the magnetic path formed by the first exciting coil 18 and the magnetic path formed by the second exciting coil 31 so that a part of the magnetic path formed by the second exciting coil 31 is superimposed on the magnetic path formed by the first exciting coil 18.

As seen from FIG. 6, the first exciting coil 18, the stator portion 19*b*, and the movable core 15, etc., are surrounded by a housing 44 made of a magnetic material, and the second exciting coil 31, the stator portion 32*a*, and the core portion 10*d* are surrounded by a housing 45 made of a magnetic material. The additional core 43 is also made of a magnetic material and is arranged between the housing 44 and the housing 45. In the embodiment illustrated in FIG. 3, the core 45 has an annular shape having a cutaway portion within an area of the terminal portion 42. Note, the core 45 may be made smaller, if necessary.

Where the maximum lift of the needle 6 is to be increased, the second exciting coil 31 is deenergized, and at this time, when the first exciting coil 18 is energized, since the magnetic path illustrated by the broken line 46 is formed, the movable core 15 is caused to move downward. At this time, by rotating the hollow cylindrical sleeve 36, since the responsiveness of the movement of the needle 6 is changed, even if, as illustrated by A' in FIG. 4, the amount of fuel injected deviates from the desired amount of fuel injected illustrated in A in FIG. 4, it is possible to adjust the amount of fuel injected so that it changes along the line A in FIG. 4.

Conversely, where the maximum amount of lift of the needle 4 is to be reduced, the second exciting coil 31 is energized, and at this time, since the magnetic flux passing through the air gap 33 and illustrated by the broken line 47 is generated, the stop member 10 is moved upward until the larger diameter lower end portion 10*a* abuts against the position restricting ring 14. In addition, at this time, as illustrated by the arrow 48, a part of the magnetic flux passes through the core portion 10*d*, the stator portion 32*a*, and the additional core 43, and another part of the magnetic flux passes the core portion 10*d*, the stator portion 32*a*, the air gap 20, the movable core 15, the stator portion 19*b*, and the additional core 43. At this time, if the size of the additional core 43 is changed, the magnetic flux 48 is changed, and thus the magnetic flux 48 passing through the air gap 20 is changed. In this case, if the first exciting coil 18 and the second exciting coil 31 are formed so that the direction of the magnetic flux formed by the first exciting coil 18 is opposite to the direction of the magnetic flux formed by the second exciting coil 31, a part of the magnetic flux 46 passing through the air gap 20 is extinguished by the magnetic flux 48. Consequently, by changing the size of the additional core 43, the attracting force for the movable core 15 is changed, and thus the responsiveness of the movement of the needle 6 is changed. Therefore, even if, as illustrated by B' in FIG. 4, the amount of fuel injected deviates from the desired amount of fuel injected illustrated by B in FIG. 4, it is possible to adjust the amount of fuel injected so that it changes along the line B in FIG. 4, by changing the size of the additional core 43.

Various method of changing the size of the additional core 43 are known. For example, a plurality of additional cores 43 having various and different thicknesses in the radial direction may be prepared in advance, or it is possible to use an additional core 43 having the same size and to cut away a part of the additional core 43 after it is assembled to the fuel injector body 1.

Where the maximum amount of lift of the needle 6 is increased by deenergizing the second exciting coil 31, although a part of the magnetic flux may pass around the second exciting coil 31 via the additional core 43, the density of the magnetic flux passing through the air gap 20 is not changed by changing the size of the additional core 43. Namely, the size of the additional core 43 has no influence on the attracting force for the movable core 43. Therefore, it is possible to independently adjust the amount of fuel injected when the maximum amount of lift of the needle 6 is small or large, respectively.

According to the present invention, as mentioned above, it is possible to adjust the amount of lift of the needle, in two steps. Also, it is possible to finely adjust the amount of fuel of injection at each step.

While the invention has been described by reference to specific embodiments chosen for purposes of illustration, it should be apparent that numerous modifications could be made thereto by those skilled in the art without departing from the basic concept and scope of the invention.

We claim:

1. A fuel injector comprising:

a housing having a fuel passage provided with a valve port therein;

a needle valve movable in said housing and cooperating with said valve port;

a first actuator for actuating said needle valve to close said valve port when a fuel injection is to be stopped and to open said valve port to control the flow rate of fuel passing through said valve port per unit time when the fuel injection is to be carried out;

control means for selectively controlling said flow rate of fuel to thereby provide one of a first flow rate of fuel and a second flow rate of fuel which is larger than said first flow rate of fuel when said needle valve opens said valve port;

wherein said control means selectively controls the flow area of said valve port to provide one of a first flow area and a second flow area, which is larger than said first flow area, when said needle valve opens said valve port by controlling an opening position of said needle valve to thereby position said valve needle at one of a first opening position to provide said first flow area and a second opening position to provide said second flow area, said control means comprising a stop member cooperating with said needle valve, and a second actuator for actuating said stop member and selectively controlling a maximum amount of lift of said needle valve to thereby provide one of a first maximum amount of lift and a second maximum amount of lift which is larger than said first maximum amount of lift;

said needle valve having an abutment member fixed thereto, and said stop member has an end face spaced from said abutment member leaving an air gap therebetween, said end face arranged to be engageable with said abutment member to thereby restrict the maximum amount of lift of said needle valve by abutting against said abutment member;

wherein said second actuator for actuating said stop member actuates said stop member to change the size of said air gap and thereby change the maximum amount of lift of said needle valve;

wherein said stop member includes a compression spring and has a bottom face positioned opposite to the end face thereof and seated on an inner wall of said housing by a spring force of said compression spring when the maximum amount of lift of said needle valve is to be said second maximum amount of lift, and the bottom face of said stop member moves away from the inner wall of said housing against the spring force of said compression spring when the maximum amount of lift of said needle valve is to be said first maximum amount of lift.

2. A fuel injector according to claim 1, wherein said housing has an abutment face arranged to be engageable with said stop member and spaced from said stop member by a predetermined distance when the maximum amount of lift of said needle valve is to be said second maximum amount of lift, and said stop member is caused to abut against said abutment face to reduce the size of said air gap by said predetermined distance when the maximum amount of lift of said needle valve is to be said first maximum amount of lift.

3. A fuel injector according to claim 2, wherein said abutment face is formed on a position restricting ring stationarily arranged in said housing.

4. A fuel injector according to claim 1, wherein said compression spring is arranged between said abutment member and said stop member.

5. A fuel injector according to claim 1, wherein said actuator for actuating said needle valve comprises a movable core movable together with said needle valve, and a first exciting coil for attracting said movable core, and said actuator for actuating said stop member comprises a second exciting coil for attracting said stop member, said second exciting coil being energized when the maximum amount of lift of said needle valve is to be said first maximum amount of lift.

6. A fuel injector according to claim 5, wherein said stop member comprises a cylindrical core portion attracted by said second exciting coil and slidably inserted in said housing.

7. A fuel injector according to claim 1, further comprising fuel amount adjustment means for adjusting the amount of fuel injected at said first maximum amount of lift in such a way that adjustment is independent of the amount of fuel at said second amount of lift.

8. A fuel injector according to claim 1, wherein said needle valve has a valve head normally closing a nozzle opening and moving outward from said nozzle opening when said valve head opens said nozzle opening.

9. A fuel injector according to claim 1, wherein said control means controls said flow rate of fuel in accordance with a change in a required amount of fuel to be injected by the fuel injector, to make said flow rate of fuel said first flow rate of fuel when said required amount of fuel is smaller than a predetermined amount and make said flow rate of fuel said second flow rate of fuel when said required amount of fuel is larger than said predetermined amount.

10. A fuel injector comprising:

a housing having a fuel passage provided with a valve port therein;

a needle valve movable in said housing and cooperating with said valve port;

a first actuator for actuating said needle valve to close said valve port when a fuel injection is to be stopped and to open said valve port to control the flow rate of fuel passing through said valve port per unit time when the fuel injection is to be carried out;

control means for selectively controlling said flow rate of fuel to thereby provide one of a first flow rate of fuel and a second flow rate of fuel which is larger than said first flow rate of fuel when said needle valve opens said valve port;

wherein said control means selectively controls the flow area of said valve port to provide one of a first flow area and a second flow area, which is larger than said first flow area, when said needle valve opens said valve port by controlling an opening position of said needle valve to thereby position said valve needle at one of a first opening position to provide said first flow area and a second opening position to provide said second flow area, said control means comprising a stop member cooperating with said needle valve, and a second actuator for actuating said stop member and selectively controlling a maximum amount of lift of said needle valve to thereby provide one of a first maximum amount of lift and a second maximum amount of lift which is larger than said first maximum amount of lift;

wherein said first actuator for actuating said needle valve comprises a movable core, movable together with said needle valve, and a first exciting coil for attracting said movable core, and said second actuator for actuating said stop member comprises a second exciting coil for attracting said stop member, said second exciting coil being energized when the maximum amount of lift of said needle valve is to be said first maximum amount of lift, further comprising a means for changing the attracting force for said movable core to adjust the amount of fuel injected by the fuel injector when the maximum amount of lift of said needle valve is said first maximum amount of lift.

11. A fuel injector according to claim 10, wherein said changing means comprises an additional core bridging a stator of said first exciting coil and a stator of said second exciting coil.

12. A fuel injector according to claim 11, wherein said additional core has an approximately annular shape and extends around said needle valve.

13. A fuel injector according to claim 10, wherein said changing means comprises a third exciting coil for adjusting the attracting force for said movable core, and a control device for controlling a power supplied to said third exciting coil, said third exciting coil being excited when said second exciting coil is excited.

14. A fuel injector according to claim 13, wherein said control device comprises a variable resistor connected in series to said third exciting coil.

15. A fuel injector comprising:

a housing having a fuel passage provided with a valve port therein;

a needle valve movable in said housing and cooperating with said valve port;

a first actuator for actuating said needle valve to close said valve port when a fuel injection is to be stopped and to open said valve port to control the flow rate of fuel passing through said valve port per unit time when the fuel injection is to be carried out;

control means for selectively controlling said flow rate of fuel to thereby provide one of a first flow rate of fuel and a second flow rate of fuel which is larger than said first flow rate of fuel when said needle valve opens said valve port;

wherein said control means selectively controls the flow area of said valve port to provide one of a first flow area and a second flow area, which is larger than said first flow area, when said needle valve opens said valve port by controlling an opening position of said needle valve to thereby position said valve needle at one of a first opening position to provide said first flow area and a second opening position to provide said second flow area, said control means comprising a stop member cooperating with said needle valve, and a second actuator for actuating said stop member and selectively controlling a maximum amount of lift of said needle valve to thereby provide one of a first maximum amount of lift and a second maximum amount of lift which is larger than said first maximum amount of lift;

wherein said first actuator for actuating said needle valve comprises a movable core, movable together with said needle valve, and a first exciting coil for attracting said movable core, and said second actuator for actuating said stop member comprises a second exciting coil for attracting said stop member, said second exciting coil being energized when the maximum amount of lift of said needle valve is to be said first maximum amount of lift, further comprising an adjusting means for adjusting a movement of said movable core to correct by adjusting the amount of fuel injected by the fuel injector when the maximum amount of lift of said needle valve is to be said second maximum amount of lift.

16. A fuel injector according to claim 15, wherein said adjusting means comprises a sleeve movable in said needle valve, to thereby change a spring force of a compression spring acting on said movable core.

* * * * *